US006802362B2

(12) United States Patent
Wenger et al.

(10) Patent No.: US 6,802,362 B2
(45) Date of Patent: Oct. 12, 2004

(54) FIN WITH ELONGATED HOLE AND HEAT PIPE WITH ELONGATED CROSS SECTION

(75) Inventors: Todd Michael Wenger, Lancaster, PA (US); David B. Sarraf, Elizabethtown, PA (US)

(73) Assignee: Thermal Corp., New Stanton, DE (US)

( * ) Notice: Subject to any disclaimer, the term of this patent is extended or adjusted under 35 U.S.C. 154(b) by 208 days.

(21) Appl. No.: 10/081,703

(22) Filed: Feb. 21, 2002

(65) Prior Publication Data

US 2003/0155104 A1 Aug. 21, 2003

(51) Int. Cl.[7] ..... F28D 15/00; F28F 1/30

(52) U.S. Cl. ..... 165/80.3; 165/181; 165/182; 165/104.22; 165/104.26; 165/104.33

(58) Field of Search ..... 165/182, 181, 165/80.3, 185, 104.21, 104.26, 104.33; 361/700; 257/714, 715; 174/15.2, 16.3

(56) References Cited

U.S. PATENT DOCUMENTS

| | | | | |
|---|---|---|---|---|
| 858,258 A | * | 6/1907 | Briscoe et al. | 165/182 |
| 2,737,370 A | * | 3/1956 | Frisch et al. | 165/181 |
| 4,930,100 A | | 5/1990 | Morinaga et al. | 165/104.14 |
| 5,467,816 A | | 11/1995 | Larinoff | 165/151 |
| 5,511,613 A | | 4/1996 | Mohn et al. | 165/177 |
| 5,960,866 A | * | 10/1999 | Kimura et al. | 165/104.26 |
| 6,125,035 A | * | 9/2000 | Hood, III et al. | 165/104.33 |
| 6,234,210 B1 | | 5/2001 | Millas | 138/38 |
| 6,382,307 B1 | * | 5/2002 | Wang et al. | 165/80.3 |
| 6,400,565 B1 | * | 6/2002 | Shabbir et al. | 165/104.33 |
| 6,408,934 B1 | * | 6/2002 | Ishida et al. | 165/104.33 |

FOREIGN PATENT DOCUMENTS

| | | |
|---|---|---|
| JP | 56119539 | 7/1981 |

* cited by examiner

*Primary Examiner*—A. Michael Chambers
(74) *Attorney, Agent, or Firm*—Duane Morris LLP

(57) ABSTRACT

An assembly includes a heat pipe and one or more fins. The heat pipe has an envelope with two elongated flat sides and two curved portions connecting the flat sides. The elongated sides have a length that is substantially greater than the radius of curvature of the curved portions. Each fin comprises a plate. The plate has a hole through it. The hole is sized to accommodate the envelope. The hole has two elongated flat sides and two curved portions connecting the flat sides. The elongated sides have a length that is substantially greater than a radius of curvature of the curved portions. The plate has at least one collar portion adjacent to the hole. The collar portion extends approximately in a direction normal to the plate. The collar portion is sized so as to accommodate the method of attachment of the fin to the envelope.

6 Claims, 4 Drawing Sheets

FIN WITH ELONGATED HOLE AND HEAT PIPE WITH ELONGATED CROSS SECTION

FIELD OF THE INVENTION

The present invention is related to thermal control systems generally, and more particularly to fins for dissipating heat.

BACKGROUND OF THE INVENTION

Heat pipes are widely used to transfer heat with a very small temperature drop ($\Delta T$) between the evaporator (which receives heat) and the condenser (which rejects heat to a heat sink or to the surroundings). A heat pipe is a sealed tube or envelope containing a working fluid that is a phase change material. One end of the heat pipe, called the evaporator, receives heat from a heat source. The working fluid in the evaporator vaporizes, absorbing energy as the latent heat of vaporization. At the condenser end, the heat is removed, and the vapor returns to the liquid state. The liquid is returned to the evaporator, by capillary action or by gravity, depending on the application and the configuration of the heat pipe.

Fins are widely used for dissipating heat from components that produce heat, including electronics and fossil fuel engines. Fins are the major component of most heat sinks. Fins provide extended surfaces to increase convection heat transfer. In general, a heated surface within a fluid can reject heat by convection at a rate proportional to its surface area. Fins can greatly increase the surface area of an object, particularly when a large number of parallel fins are located in a small volume. It is common to place a plurality of fins on the condenser of a heat pipe, so that a greater amount of heat can be removed from the condenser, and hence, from the heat source with a given $\Delta T$.

Heat pipes typically have a round cross section. Fins may be extruded, stamped, die cast, or folded for use as an extended heat transfer surface. Fins are applied to the exterior of the condenser, for example, by brazing.

U.S. Pat. No. 6,234,210 B1 describes a heat pipe having an elliptical cross-section. Heat exchange fins are mounted to the heat pipe at the condenser end. The fins are galvanized on the heat pipe. Spacer pins are used to support and space the heat exchange fins from each other.

An improved fin and an improved heat pipe and fin assembly are desired.

SUMMARY OF THE INVENTION

One aspect of the invention is a fin comprising a plate. The plate has a hole therethrough. The hole has two elongated flat sides and two curved portions connecting the flat sides. The elongated sides have a length that is substantially greater than a radius of curvature of the curved portions. The plate has at least one collar portion adjacent to the hole. The collar portion extends approximately in a direction normal to the plate.

Another aspect of the invention is a heat pipe assembly, comprising: a heat pipe and at least one fin. The heat pipe has an envelope. The envelope has two elongated flat sides and two curved portions connecting the flat sides. The elongated sides have a length that is substantially greater than a radius of curvature of the curved portions. The at least one fin comprises a plate. The plate has a hole therethrough that is sized to accommodate the envelope of the heat pipe. The hole has two elongated flat sides and two curved portions connecting the flat sides. The elongated sides have a length that is substantially greater than a radius of curvature of the curved portions. The plate has at least one collar portion adjacent to the hole. The collar portion extends approximately in a direction normal to the plate.

Still another aspect of the invention is a method for making a heat pipe assembly, comprising: providing a heat pipe having an envelope, the envelope having two elongated flat sides and two curved portions connecting the flat sides, the elongated sides having a length that is substantially greater than a radius of curvature of the curved portions; forming a fin having a hole therethrough sized and shaped so as to accommodate the envelope; and placing the fin on the envelope.

DETAILED DESCRIPTION

Figure 1:
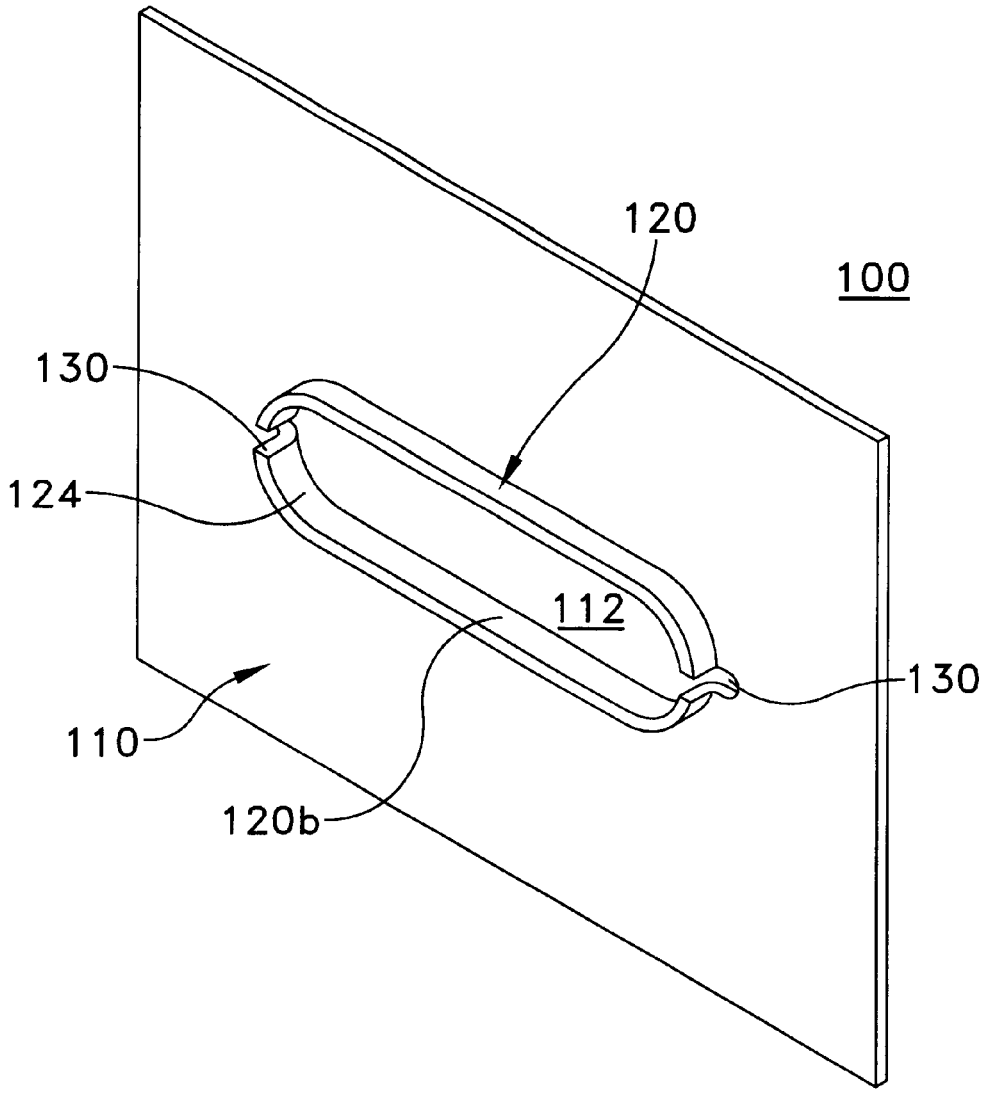
FIG. 1 is an isometric view of an exemplary fin according to the present invention.
Figure 3:
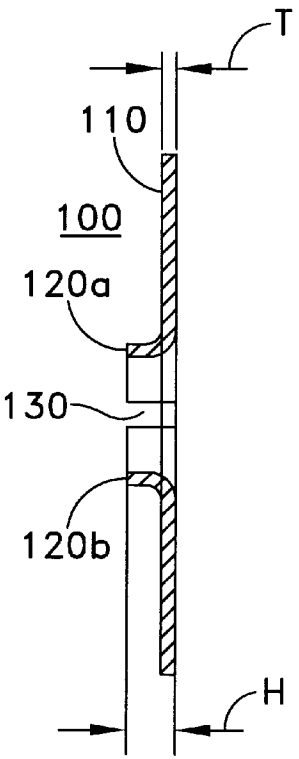
FIG. 3 is a cross sectional view taken along section line 3—3 of FIG. 2.
Figure 2:
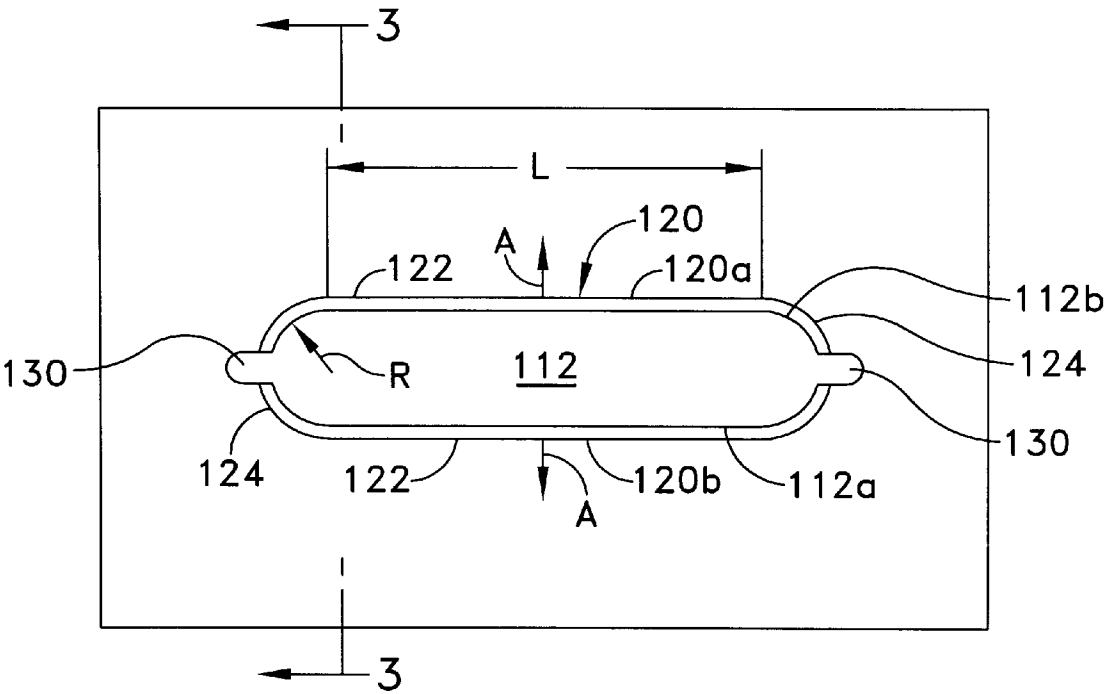
FIG. 2 is a front elevation view of the fin of FIG. 1.

FIGS. 1-3 show an exemplary fin 100 according to the present invention. Fin 100 comprises a plate 110. The plate 110 has a hole 112 therethrough. The hole 112 has two elongated flat sides 112*a* and two curved portions 112*b* connecting the flat sides. The elongated sides 112*a* have a length L that is substantially greater than a radius of curvature R of the curved portions 122*b*. For example, the length L may be five to ten times the radius R of the curved portions, or larger. In a preferred embodiment, the length L is about seven times the radius R.

The plate 110 has a collar 120 comprising at least one collar portion 120*a* adjacent to the hole 112. The exemplary plate 110 has at least two collar portions 120*a* and 120*b*, which are separated from one another by a pair of slots 130. The collar portions 120*a*, 120*b* extend approximately in a direction normal to the plate 110, as best seen in FIG. 2, with a radius of curvature, as best seen in FIG. 1. Any number of slots 130 may be provided, resulting in the same number of collar portions 120*a*–120*b* as slots 130. A larger number of slots 130 forms the collar portions into a plurality of relatively narrow blades or projecting fingers that readily flex to accommodate a heat pipe within the collar.

Fin 100 may be made of a variety of materials. The selected material should be compatible with the material of the heat pipe to which the fin is attached, and the fin must be capable of manufacture by a suitable process. For example, the exemplary method of manufacture includes stamping and drawing the fin, so materials that can be stamped and drawn, such as aluminum or copper, are desirable.

Figure 4:
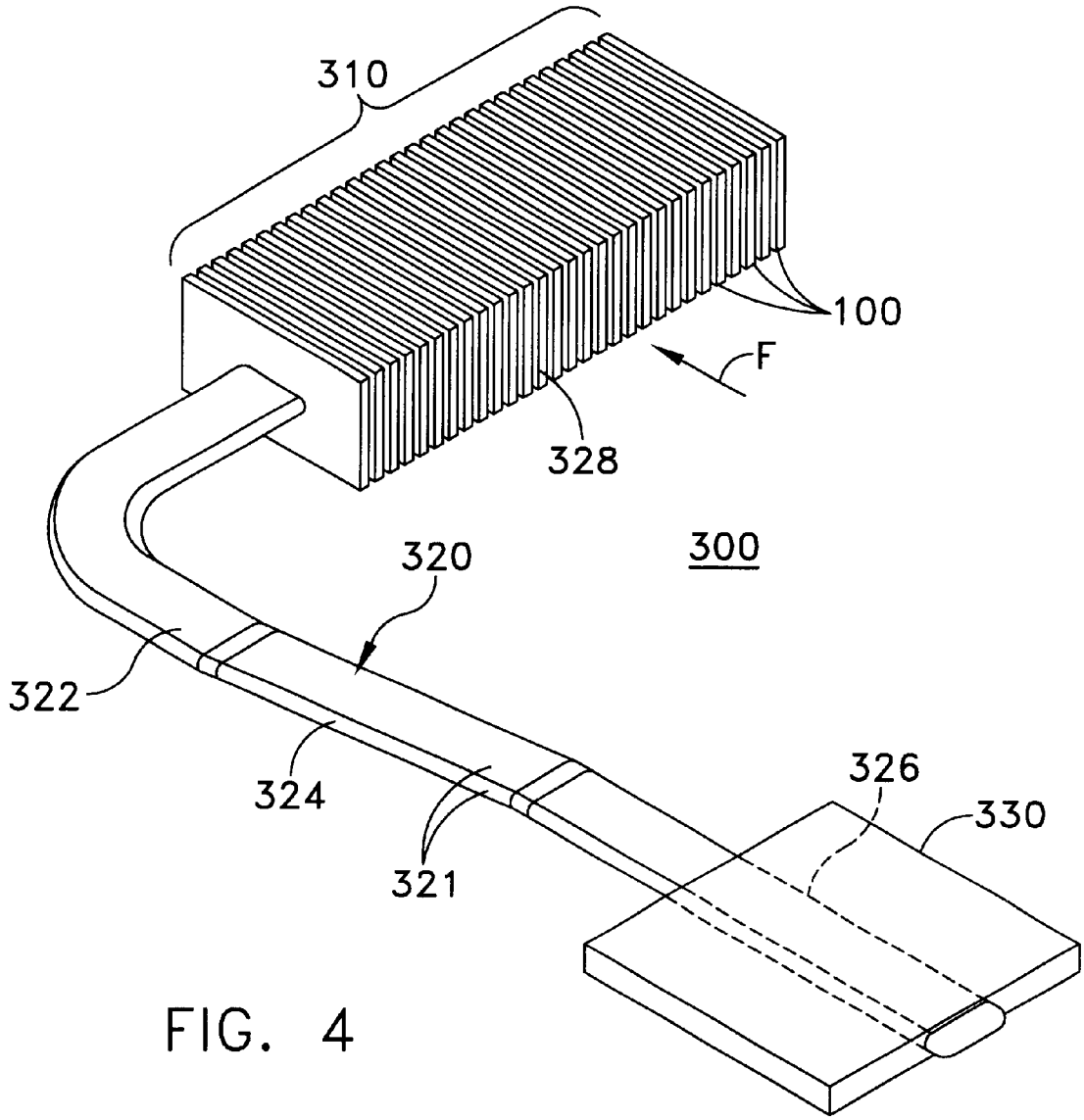
FIG. 4 is an isometric view of a heat pipe assembly including a plurality of fins of the type shown in FIG. 1, arranged in a finstack.

Exemplary fin 100 is adapted to be compression fitted onto a heat pipe having a cross section with elongated flat sides and curved ends. Fin 100 can also be sized to have the heat pipe air expanded to the fin or attached by any other conventional means. FIG. 4 is an isometric view of an exemplary assembly 300 including a heat pipe 320 having elongated flat sides 322 and curved ends 324. The heat pipe 320 has an envelope 321 and a working fluid (not shown) inside the envelope. The envelope 321 has two elongated flat sides 322 and two curved portions 324 connecting the flat sides. The elongated sides 322 have a length (equal to L, or slightly greater than L) that is substantially greater than a radius of curvature of the curved portions (equal to R, or slightly greater than R) of the envelope 321. Because L is substantially greater than R, heat pipe 320 provides a large flat contact surface for interfacing to a heat source that is to be cooled.

Although the exemplary method of attaching the fin 100 to the heat pipe 320 is compression fitting, the fin can be attached by any number of conventional methods, such as soldering, gluing, air expanding, and the like. One of ordinary skill in the art can readily size the hole 112 and collar 120 to accommodate the specific method of attachment used for any particular embodiment of the fin.

The assembly 300 has at least one fin 100. Preferably, a plurality of fins 100 are included in a finstack 310 at the condenser end 328 of the heat pipe 320 Each fin 100 comprises a plate 110 having a hole 112 therethrough that is sized to accommodate the envelope 321. The plate 110 has two collar portions 120*a*, 120*b* adjacent to the hole 112. The collar portions 120*a*, 120*b* extend approximately in a direction normal to the plate 110, as best seen in FIG. 3. The collar portions 120*a*, 120*b* may be considered to be blades or finger-like projections. The collar portions 120*a*, 120*b* bend elastically by a small distance in the direction of the arrows labeled "A" in FIG. 2, enabling the collar 120 to receive a heat pipe 320 that is slightly larger than the side of the hole 112 when the collar 120 is in its uncompressed state.

As noted above, the elongated sides 112*a* have a length L (equal to or slightly less than the length of the flat sides 324 of the heat pipe 320) and the radius of curvature of the curved portions 112*b* is R (equal to or slightly less than the radius of the curved sides of the heat pipe 320). Thus, the exemplary collar portions 120*a*, 120*b* are sized so as to be placed in light compression when the fin 100 is placed around the envelope 321. Thus the fins 100 grip the heat pipe 320, and can maintain their positions without brazing, soldering or mechanical fasteners.

The collar 120 can serve a dual purpose. In addition to supporting the fin 100 on the heat pipe 320, the height H of the collar 120 (best seen in FIG. 3) controls the spacing between fins 100, obviating the need for separate spacers. By controlling H, the density of fins 100 in the finstack 310 is controlled.

Although the exemplary plate 110 has two collar portions 120, separated from one another by a pair of slots 130, any number of slots may be used. The slots 130 may be located on either the flat sides 112*a* or the curved ends 112*b* of the hole 112. In particular, if slots (not shown) are located at both ends of each flat side 112*a*, then the curved end collar portions can deflect away from each other to receive a heat pipe having a slightly longer flat side. If several (e.g., eight or ten) slots are provided, then the fin can more easily fit over the envelope 321 of the heat pipe 320 with a greater dimensional tolerance and improved thermal contact with the heat pipe.

Assembly 300 is thermally coupled to a heat source 330 at the evaporator end 326 of heat pipe 320. Heat source 330 may be, for example, an integrated circuit or a printed circuit board in a laptop or desktop computer. Other applications of the exemplary assembly are contemplated, and can readily be recognized by those of ordinary skill in the art.

Advantageously, air or another coolant can flow across the finstack 310 in the direction labeled "F" in FIG. 4 with a relatively small pressure drop, compared to prior art heat pipes that have circular or rectangular cross sections. Sizing the flat size of the heat pipe 320 and hole 112 to be substantially greater than the radius of curvature R of the curved portions makes this possible. One of ordinary skill in the art will recognize that an assembly 300 according to the invention may be used in any configuration where it is desirable to increase the effectiveness of one or more fins 100 by reducing the fraction of the fin that is affected by the wake of the heat pipe envelope. Thus, a condenser having a given heat rejection capacity can occupy a smaller volume than prior art systems.

One of ordinary skill in the art can readily vary the dimensions of the fin 100 and heat pipe 320 to achieve a desired effect. The aspect ratio of the fin 100 and heat pipe 320 can be adjusted to suit a given available condenser volume. The number of notches 130 can be varied to suit the profile of the heat pipe 320. The thickness T (shown in FIG. 3) of the fin plate 110 can be adjusted to suit a specific application. Techniques for designing the thickness of a fin are well known in the art.

Although the exemplary fin 100 is rectangular, the fin may have other shapes. For example, fin 100 may have rounded corners instead of square corners.

Although the exemplary fin 100 is formed from stock of uniform thickness, fins having varying thickness T may be used. For example, tapered fins may be used having a thickness T that is greater near the hole 112, and thinner near the outer edges of the fins.

A method for making a heat pipe assembly comprises providing a heat pipe 320 having an envelope 321. The envelope 321 has two elongated flat sides 322 and two curved portions 324 connecting the flat sides.

A fin 100 is formed, for example, by stamping the fin from a plate of a suitable material that is the same as or compatible with the material of the envelope 321. The stamping operation forms a hole 112 through the plate 110 that is smaller than a cross section of the heat pipe. The extent to which the hole 112 is initially smaller than the heat pipe 320 is approximately the final height H of the collar, because the height H is formed by turning the extra material outward from the hole 112 to a direction normal to the plate 110. Preferably, a plurality of notches 130 are also formed by the stamping operation.

At the end of the stamping operation, the plate (including the collar portion 120) may still be flat. The collar 120 is then drawn or extruded, so that the collar portion extends approximately in a direction normal to the fin 100.

Alternatively, the stamping operation may include the step of forming the collar 120 so that the collar portion extends approximately in a direction normal to the fin 100.

Figure 7:
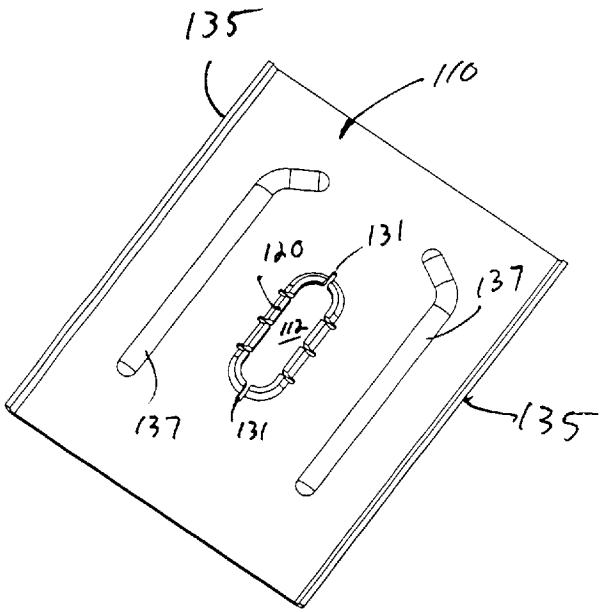
FIG. 7 is a perspective view of the alternative embodiment of the fin of FIG. 5.
Figure 5:
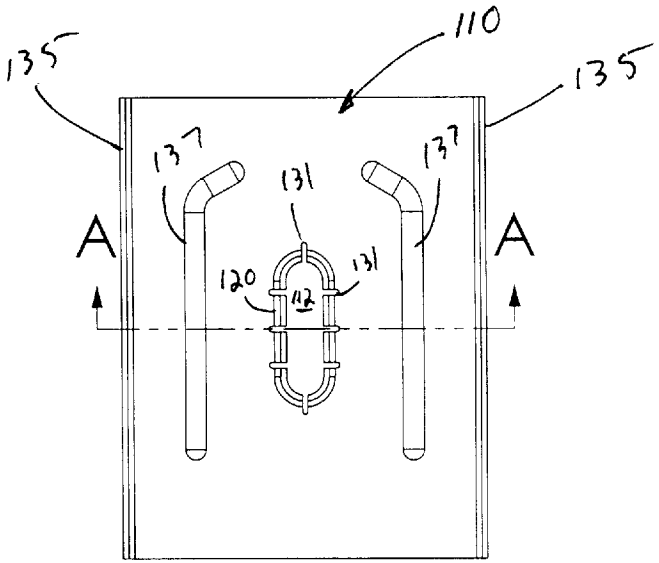
FIG. 5 is a front elevation view of an alternative embodiment of the fin of FIG. 1.
Figure 6:
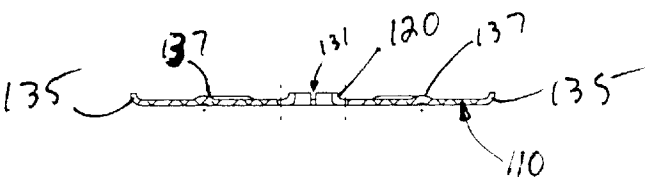
FIG. 6 is a cross sectional view taken along section line A—A of FIG. 5.

Any number of methods can be used to incorporate spacers on the fins such as the collar, embossments or folding the corners of the fin. The addition of multiple slots 131 in the straight portion of the fin increases the ability of the fin to conform to irregular mating surfaces and decreases the force required to push the fin over the heat pipe. Slots 131 may weaken the fin somewhat so as to allow flexing. This positioning of slots in the fin structure has had the tendenacy to weaken the bond between the fin and the heat pipe in prior art fins, which has reduced their thermal performance. At least two structures are provided in the present invention to restore the strength of the fin. Bent edges 135 form a wide substantially C-channel (FIGS. 5-7) which acts as a stiffener. Additionally, embossed stiffeners 137 may be formed in portions of plate 110 to again provide structural rigidity to the fin and thereby prevent the weakening the bond between the fin and the heat pipe that may result from multiple slots 131.

It will be understood that both bent edges 135 and embossed stiffeners 137 also provide the additional advantage of ducting and directing airflow. This consequently improves the performance of the finstack beyond what would be expected from a stack lacking either of these two features. The C-channels cross-sectional profile formed by the addition of bent edges 135 serves as a duct that assures that the airstream remains captured within the finstack rather than prematurely exiting through the top and bottom. This increases the airflow through the latter portion of the finstack and decreases the thermal resistance of the assembly. Embossed stiffeners 137 serve as flow directors that, when angled, can help to direct the airflow over the trailing edge of the fin toward an area that is typically in the shadow or wake of the heat pipe and which ordinarily would not fully participate in heat exchange. Embossed stiffeners 137 also serve the secondary role of turbulators which help thin the boundary layer and increase the effective heat transfer coefficient into the fluid (air) stream.

Once a plurality of fins 100 are formed, the fins are placed around the heat pipe 320, so that the collar portion grips the envelope 321. The method of forming the fin will vary with the method of attachment of the fin.

Although the invention has been described in terms of exemplary embodiments, it is not limited thereto. Rather, the appended claim should be construed broadly, to include other variants and embodiments of the invention, which may be made by those skilled in the art without departing from the scope and range of equivalents of the invention.

What is claimed is:

1. A fin comprising a plate, said plate having a hole therethrough, the hole being defined by two elongated flat sides of said plate and two curved portions connecting the flat sides, the elongated sides having a length that is substantially greater than a radius of curvature of the curved portions, said plate having two collar portions adjacent to the hole, the collar portions extending approximately in a direction normal to said plate, wherein the two collar portions are separated from one another by a pair of slots each being centrally defined in a respective one of said two curved portions of said plate.

2. The fin of claim 1, wherein the collar portions are formed by drawing.

3. A heat pipe assembly, comprising:

a heat pipe having an envelope, the envelope having two elongated flat sides and two curved portions connecting the flat sides, the elongated sides having a length that is substantially greater than a radius of curvature of the curved portions; and at least one fin comprising a plate, the plate having a hole therethrough that is sized to accommodate the envelope, the hole being defined by two elongated flat sides of said plate and two curved portions connecting the flat sides, the elongated sides having a length that is substantially greater than a radius of curvature of the curved portions, the plate having two collar portions adjacent to the hole, the collar portions extending approximately in a direction normal to the plate, wherein the two collar portions are separated from one another by a pair of slots each being centrally defined in a respective one of said two curved portions of said plate.

4. The heat pipe assembly of claim 3, wherein the collar portions are formed by stamping.

5. The heat pipe assembly of claim 4, wherein the collar portions are further formed by drawing.

6. The heat pipe assembly of claim 3, wherein the assembly includes a plurality of fins.

* * * * *